US006456249B1

(12) United States Patent
Johnson et al.

(10) Patent No.: US 6,456,249 B1
(45) Date of Patent: Sep. 24, 2002

(54) SINGLE OR DUAL BAND PARASITIC ANTENNA ASSEMBLY

(75) Inventors: Greg Johnson, Aptos; Ben Newman, Santa Cruz, both of CA (US)

(73) Assignee: Tyco Electronics Logistics A.G. (CH)

( * ) Notice: Subject to any disclaimer, the term of this patent is extended or adjusted under 35 U.S.C. 154(b) by 0 days.

(21) Appl. No.: 09/837,132

(22) Filed: Apr. 18, 2001

Related U.S. Application Data

(63) Continuation-in-part of application No. 09/374,782, filed on Sep. 16, 1999, now Pat. No. 6,215,447.
(60) Provisional application No. 60/163,515, filed on Nov. 4, 1999.

(51) Int. Cl.[7] ..... H01Q 1/24; H01Q 1/38
(52) U.S. Cl. ..... 343/702; 343/700 MS
(58) Field of Search ..... 343/700 MS, 712, 343/848, 815, 702, 846

(56) References Cited

U.S. PATENT DOCUMENTS

| | | | | | |
|---|---|---|---|---|---|
| 5,420,596 | A | * | 5/1995 | Burrell et al. | 343/700 MS |
| 5,598,169 | A | | 1/1997 | Drabeck et al. | 343/701 |
| 5,627,550 | A | | 5/1997 | Sanad | 343/700 |
| 5,644,319 | A | | 7/1997 | Chen | 343/702 |
| 5,764,190 | A | | 6/1998 | Murch et al. | 343/702 |
| 5,966,097 | A | * | 10/1999 | Fukasawa et al. | 343/700 MS |
| 6,114,996 | A | * | 9/2000 | Nghiem | 343/700 MS |

* cited by examiner

*Primary Examiner*—Don Wong
*Assistant Examiner*—James Clinger
(74) *Attorney, Agent, or Firm*—John F. Klos; Fulbright & Jaworski L.L.P.

(57) ABSTRACT

A compact single or multiple band antenna assembly for wireless communications devices. One multi-band embodiment includes a high frequency portion and a low frequency portion, both fed at a common point by a single feed line. Both portions may be formed as a single stamped metal part or metallized plastic part. The overall size is suitable for integration within a wireless device such as a cell phone. The low frequency portion consists of two resonant sections which are stagger tuned to achieve a wide resonant bandwidth, thus allowing greater tolerance for manufacturing variations and temperature than a single resonant section, and is useful for single band antennas as well as multi-band antennas where it may be used to enhance bandwidth for both sections of a dual band antenna as well. The resonant sections for single or multi-band antennas operate in conjunction with a second planar conductor, which may be provided by the ground trace portion of the printed wiring board of a wireless communications device. The antenna assembly provides a moderate front-to-back ratio of 3–12 dB and forward gain of +1 to +5 dBi. The front to back ratio reduces the near field toward the user of a hand held wireless communications device, thus reducing SAR (specific absorption rate) of RF energy by the body during transmit. The antenna pattern beam width and bandwidth are increased for a handset during normal user operation, as compared to a half wave dipole.

25 Claims, 17 Drawing Sheets

SINGLE OR DUAL BAND PARASITIC ANTENNA ASSEMBLY

RELATED APPLICATIONS

This application is a continuation-in-part application pursuant to 37 C.F.R. 1.53(b) of application Ser. No. 09/374,782, filed Sep. 16, 1999, now U.S. Pat. No. 6,215,447.

This application claims the benefit of priority pursuant to 35 U.S.C. §119 of copending PCT application Ser. No. PCT/US00/30428 filed Nov. 4, 2000. PCT application Serial No. PCT/US00/30428, claimed the benefit of U.S. Provisional Application No. 60/163,515 filed Nov. 4, 1999.

FIELD OF THE INVENTION

The present invention relates to an antenna assembly suitable for wireless transmission of analog and/or digital data, and more particularly to a parasitic element antenna assembly for single or multiple band wireless communications devices.

BACKGROUND OF THE INVENTION

There exists a need for an improved antenna assembly that provides a single and/or dual band response and which can be readily incorporated into a small wireless communications device (WCD). Size restrictions continue to be imposed on the radio components used in products such as portable telephones, personal digital assistants, pagers, etc. For wireless communications devices requiring a dual band response the problem is further complicated. Positioning the antenna assembly within the WCD remains critical to the overall appearance and performance of the device.

Known antenna assemblies for wireless communication devices include:

1. External single or multi band wire dipole:

Features of this antenna includes an external half wave antenna operating over one or more frequency range; a typical gain of +2 dBi; negligible front-to-back ratio; and minimal specific absorption rate (SAR) reduction (SAR 2.7 mw/g typ @ 0.5 watt transmit power level). Multiple band operation is possible with this antenna by including LC (inductor and capacitor) traps used to achieve multi band resonances.

2. External single or multi band asymmetric wire dipole:

Features of this antenna include an external quarter wave antenna operating over one or more frequency range; typical gain of +2 dBi; and minimal front-to-back ratio and SAR reduction. LC traps may also be used to achieve multi-band resonance.

3. Internal single or multi band asymmetric dipole:

Features of this antenna include a quarter wave resonant conductor traces, which may be located on a planar printed circuit board; typical gain of +1–2 dBi; slight front-to-back ratio and reduced SAR (2.1 mw/g.). This antenna may include one or more feedpoints for multiple band operation. A second conductor may be necessary for additional band resonance.

4. Internal or single multi band PIFA (planar inverted F antenna):

Features of this antenna include a single or multiple resonant planar conductor; typical gain of +1.5 dBi; and front-to-back ratio and SAR values being a function of frequency. A dual band PIFA antenna for 824–894/1850–1990 MHz operation may exhibit 2 dB gain and present minimal front-to-back ratio and reduced SAR of 2 mw/g in the lower frequency band.

SUMMARY OF THE INVENTION

A compact single or multiple band antenna assembly for wireless communications devices is described. One multi-band implementation includes a high frequency portion and a low frequency portion, both fed at a common point by a single feedline. Both portions may be formed as a single stamped metal part or metallized plastic part. The overall size is suitable for integration within a wireless device such as a cellphone.

Further, the low frequency portion consists of two resonant sections which are stagger tuned to achieve a wide resonant bandwidth, thus allowing greater tolerance for manufacturing variations and temperature than a single resonant section. This feature is useful for single band antennas as well as multi-band antennas. This feature may also be used to enhance bandwidth for both sections of a dual band antenna as well.

The resonant sections for single or multi-band antennas operate in conjunction with a second planar conductor, which may be provided by the ground trace portion of the printed wiring board of a wireless communications device. An antenna assembly so formed provides a moderate front-to-back ratio of 3–12 dB and forward gain of +1 to +5 dBi. The front to back ratio reduces the near field toward the user of a hand held wireless communications device, thus reducing SAR (specific absorption rate) of RF energy by the body during transmit. Antenna pattern beamwidth and bandwidth is increased for a handset during normal user operation, as compared to a half wave dipole. An antenna assembly according to the present invention may provide increased beamwidth when the WCD is near the user head in the talk position, by a factor of 1.5–2.

An object of the present invention is thus to satisfy the current trends which demand a reduction in size, weight, and cost for wireless communication devices.

Another object of the present invention-is the provision of multiple stagger-tuned resonant elements to enhance operational beamwidth and bandwidth, and providing an improved margin for manufacturing tolerances and environmental effects. An improved beamwidth and bandwidth of the handset may translate into improved communication by increasing the number of illuminated cell sites during operation.

Another object of the present invention is the provision of an antenna assembly which is extremely compact in size relative to existing antenna assemblies. The antenna assembly may be incorporated internally within a wireless handset. A unique feed system without matching components is employed to couple the antenna to the RF port of the wireless handset. The antenna assembly requires small-area RF ground lands for mounting, and is effectively a surface mount device (SMD). Beneficially, the antenna assembly may be handled and soldered like any other SMD electronic component. Because the antenna is small, the danger of damage is prevented as there are no external projections out of the WCD's housing. Additionally, portions of the antenna assembly may be disposed away from the printed wiring board and components thereof, allowing components to be disposed between the antenna assembly and the printed wiring board (PWB).

Another object of the present invention is an antenna assembly providing substantially improved electrical performance versus volume ratio, and electrical performance versus cost as compared to known antenna assemblies. Gain of the antenna assembly according to the present invention may be nominally equal to an external ¼ wave wire antenna, with SAR level less than 1.6 mw/g achieved at 0.5 watt input for an internally mounted antenna. The 3 dB beamwidths are significantly higher than a dipole antenna during normal user operation. The performance characteristics are found across a wide range of environmental operating conditions, e.g., at temperatures ranging from −40 to +60 degrees C.

Components of the antenna assembly may be manufactured in different ways. It is conceivable for example that the antenna can be formed from a punched or etched sheet. In a preferred embodiment, the antenna may be formed from a single-piece metal stamping adaptable to high volume production. Additionally, capacitor elements may be coupled to the antenna assembly through known high volume production techniques.

Another object of the present invention is to provide an antenna assembly having improved operational characteristics, including an increased front-to-back ratio and a decreased specific absorption rate of RF energy to the user of an associated wireless communications device.

Accordingly, it is the primary object of the present invention to provide an improved antenna assembly for communications devices including portable cellular telephones and PCS devices with improved directionality, broadband input impedance and increased signal strength. The present invention additionally reduces radio frequency radiation incident to the user's body and reduces the physical size requirements for a directional antenna assembly used on communications devices.

It is still an additional object of the present invention to provide a compact antenna assembly suitable for incorporation within the housing of a portable wireless communication device. The current invention provides compact, discrete antenna assembly without external appendages, such as provided by known external dipole antennas.

BRIEF DESCRIPTION OF THE DRAWINGS

The accompanying drawings illustrate preferred embodiments of the invention and together with the description, serve to explain the principles of the invention. In the drawings.

DETAILED DESCRIPTION OF PREFERRED EMBODIMENTS

Figure 1:
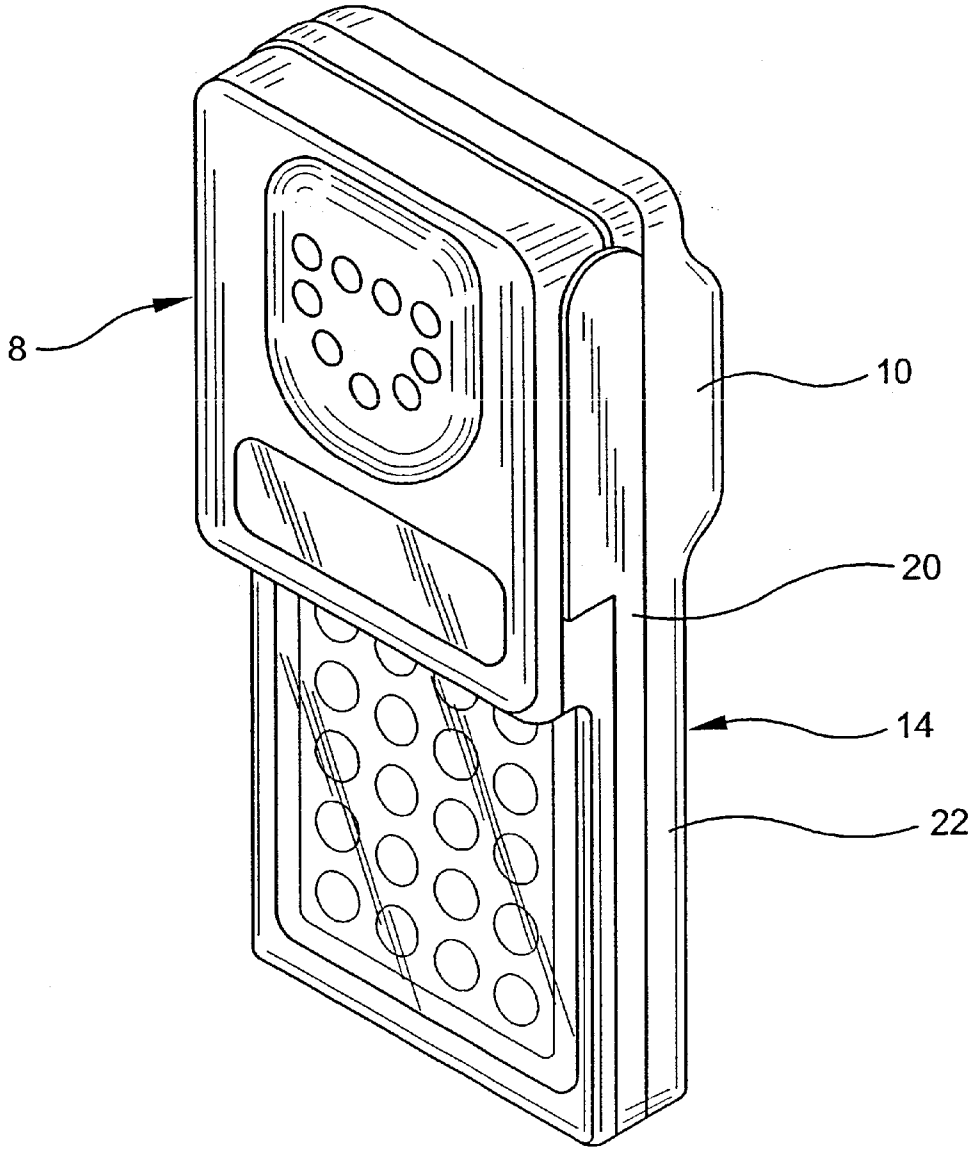
FIG. 1 is a perspective view of a communication device incorporating an antenna assembly according to the present invention.
Figure 2:
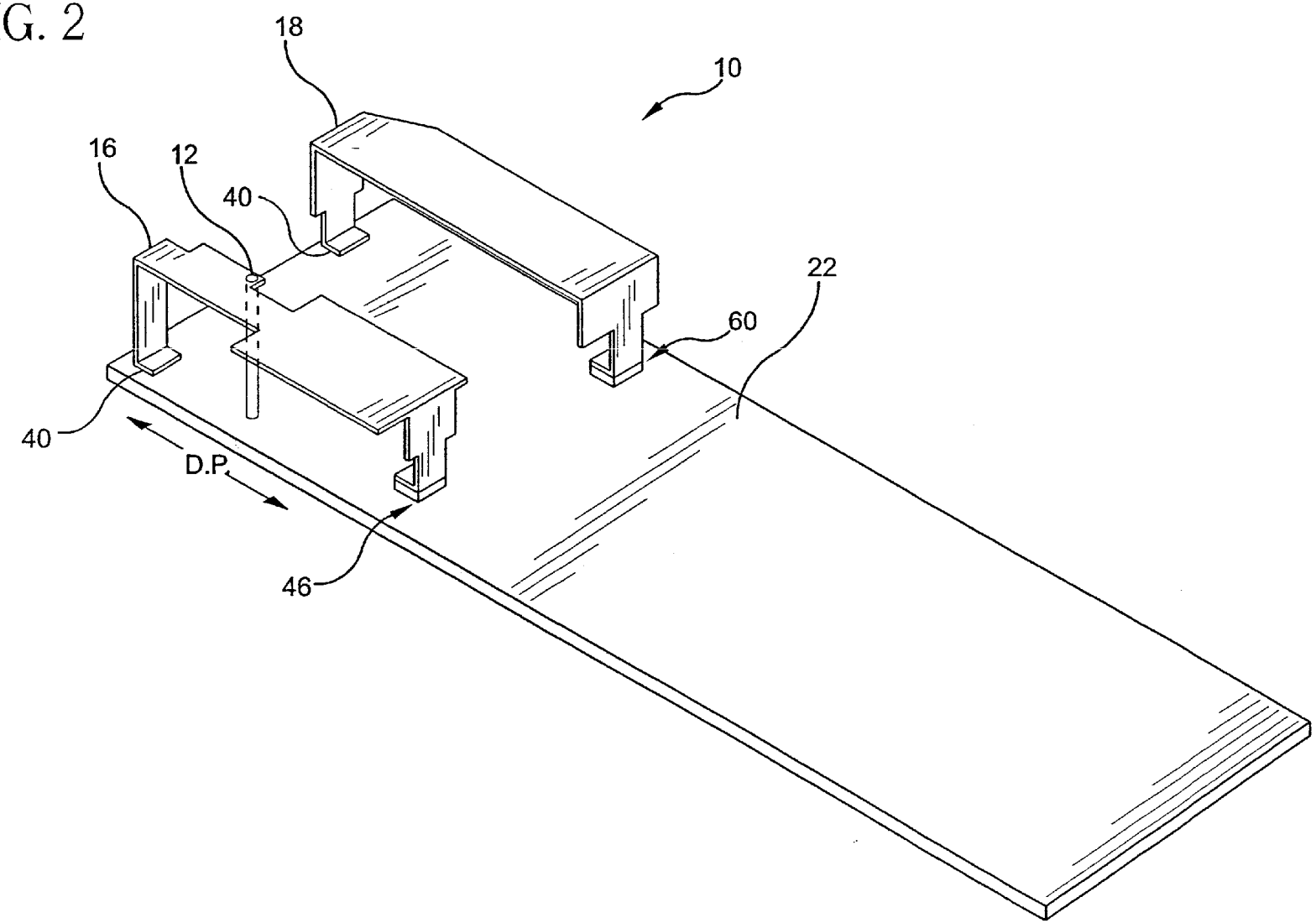
FIG. 2 is a perspective view of an antenna assembly according to the present invention.
Figure 3:
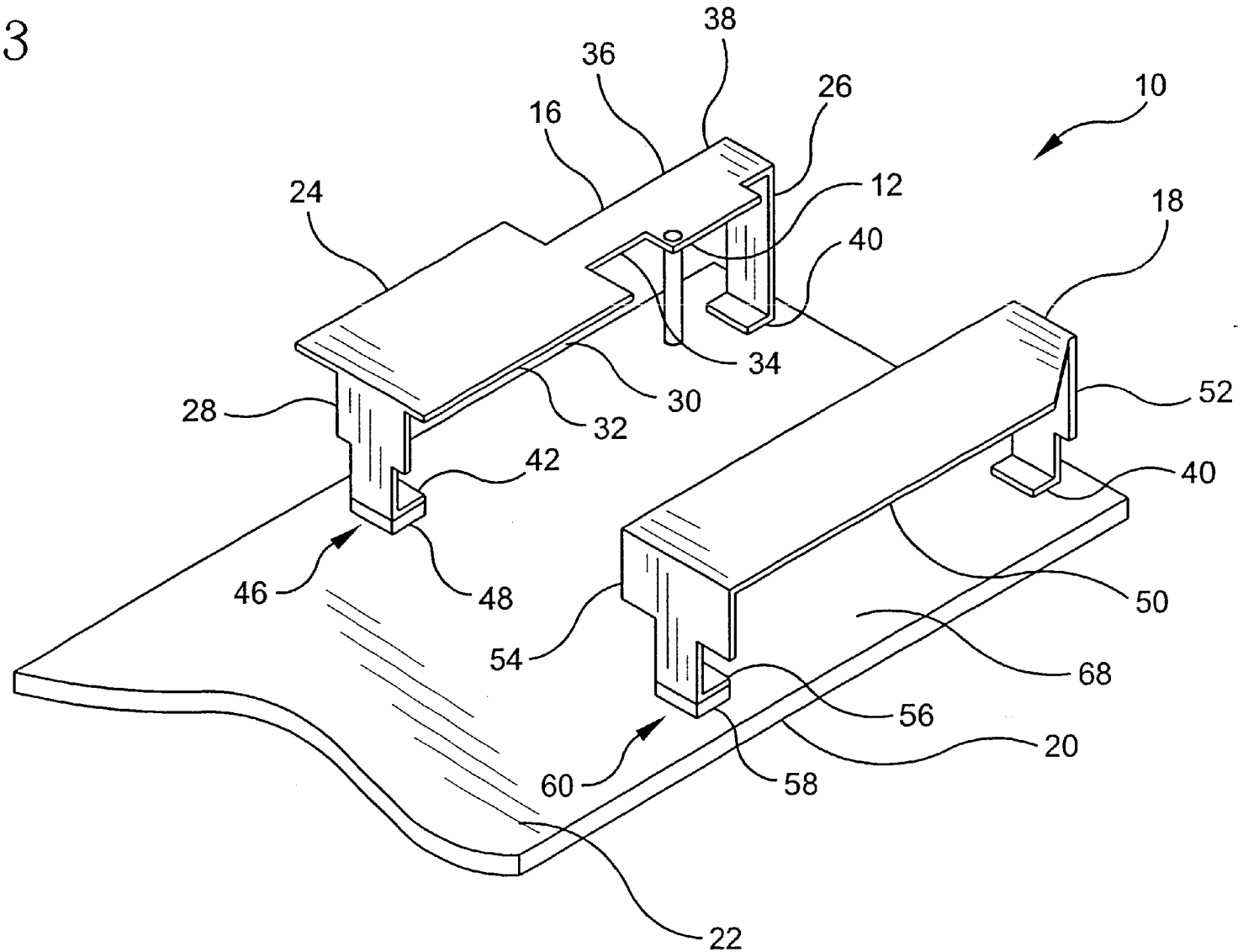
FIG. 3 is a perspective view of an antenna assembly according to the present invention.

Referring now to the drawings, wherein like numerals depict like parts throughout, FIG. 1 illustrates a wireless communication device 8, such as a cellular telephone, utilizing an antenna assembly 10 according to the present invention and operating over the cell band frequency range of 824–894 MHz. The antenna assembly 10 may be disposed within the communication device 8 at the rear panel 14 and proximate the upper portion of the handset (away from a user's hand), as illustrated in the embodiment of FIG. 1. A first embodiment of an antenna assembly 10 includes a driven conductor element 16 and a parasitic conductor element 18 each disposed relative to a ground plane element 20 of the wireless communication device 8 is illustrated in FIGS. 2 and 3. The ground plane element 20 may be defined as a portion of the printed wiring board (PWB) 22 of the communication device 8. Driven conductor element 16 includes a conductive surface 24 with first and second leg elements 26, 28 and may be a singularly formed metallic member. Driven conductor element 16 may be a metallic chassis made, for example, of copper or a copper alloy. The driven conductor element 16 is approximately "C" shaped when viewed from its side and defines an interior region 30 disposed between the conductive surface 24 and the ground plane element 20. Components of the communication device 8 may thus be disposed within the interior region 30 to effect a reduction in overall volume of the device.

The conductive surface 24 is disposed a predetermined distance above the ground plane element 20 and includes a plurality of sections having different widths for effecting optimal operation over the cell band frequency range (824–894 MHz.). A first rectangular section 32 is approximately 0.42 inch by 0.61 inch in size for a preferred embodiment. A second rectangular section 34 disposed at an upper edge of the first section 32 is approximately 0.1 inch by 0.42 inch in size. A third rectangular section 36 disposed at an upper edge of the second section 34 is approximately 0.2 inch by 0.25 inch in size. A fourth rectangular section 38 disposed at an upper for a preferred embodiment of the present invention are disclosed in FIGS. 8–9 and Table 1.

Conductive surface 24 is electrically or operatively connected at an upper edge of the fourth section 38 to a downwardly-directed, perpendicular first leg element 26 which is shorted to the ground plane 20 at foot 40. One or more feet 40 may be practicable to provide for stability of the driven element 16 or routing requirements of the printed wiring board 22 of the communication device. Preferably a single foot 40 is utilized to minimize the contact requirements to the ground plane 20 and otherwise minimize physical interference with other components of the printed wiring board 22.

Figure 16:
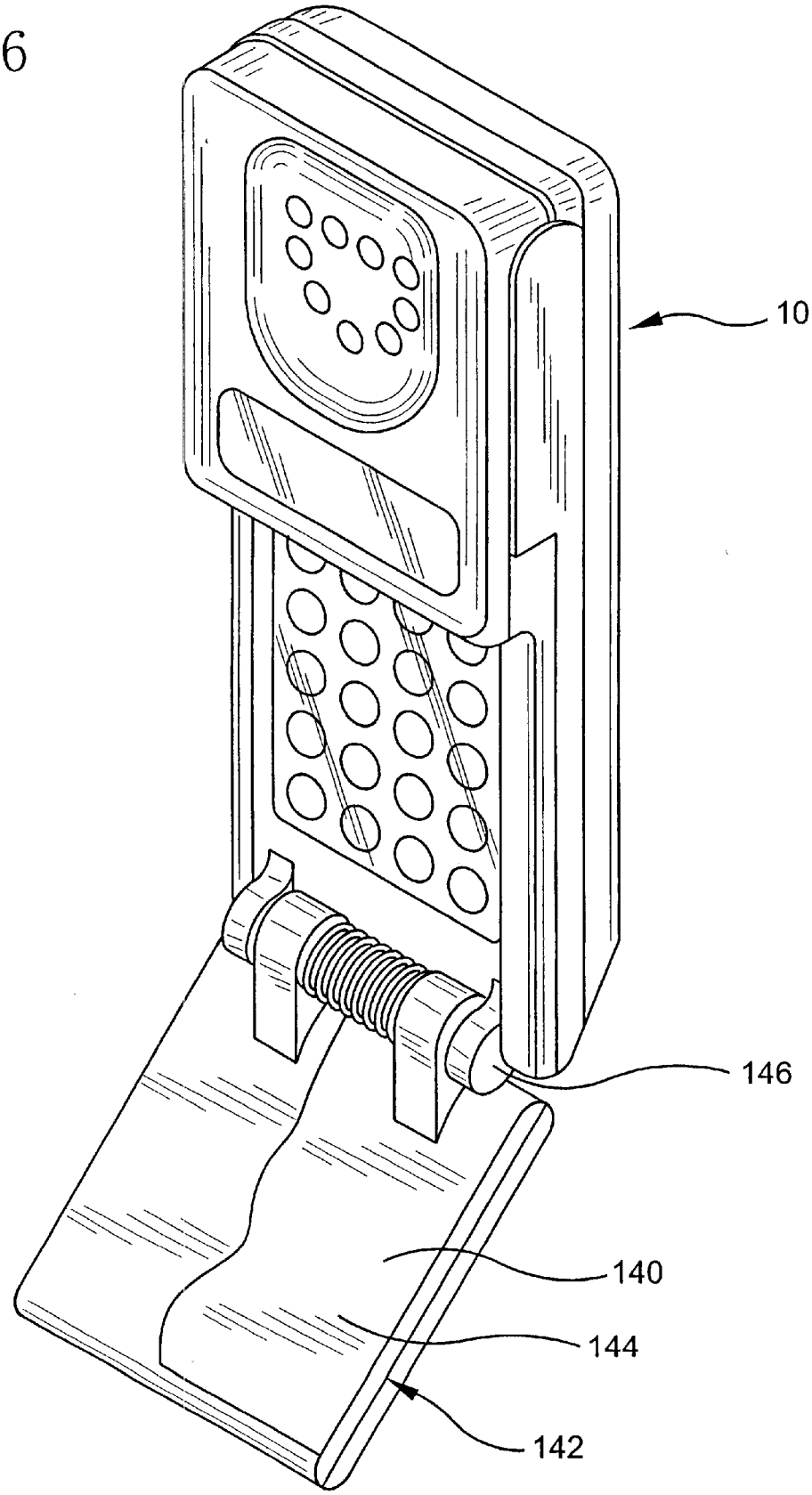
FIG. 16 is a perspective view of a hand-held communications device according to another aspect of the present invention wherein the ground plane element of the antenna assembly is extended into a flip-portion of the communications device.

Conductive surface 24 is also coupled at a lower edge of the first section 32 to a downwardly-directed perpendicular second leg element surface 28. Second leg element 28 includes a 'T' shaped profile to minimize the interference with other components of the printed wiring board 22. Second leg element 28 includes a perpendicular foot 42 for capacitively coupling driven conductor 16 to the ground plane member 20. One or more feet 42 may be practicable to provide for conductor stability or wire routing requirements of the printed circuit board 22 the communication device. Ground plane element 20 preferably has a minimum length in a direction of polarization 'DP' of approximately one-quarter wavelength (for a wavelength within the range of operation). Reference may be made to FIG. 16, wherein an approach to extending the ground plane member 20 of a small hand-held communication device is provided. Driven conductor element 16 may be a single metallic formed element having a thickness within the range of 0.005 to 0.09 inch.

Second leg element 28 includes a foot 42 which defines one side or plate of a two plate capacitor 46. Foot 42 is spaced away from the ground plane element 20 by a dielectric element 48 so as to form a capacitor. Dielectric element 48 may have a dielectric constant of between 1–10, and preferably approximately 3.0.

The parasitic element 18 of antenna assembly includes a 'C'-shaped element which is spaced away from the driven element 16. Parasitic element 18 includes a conductive portion 50 with first and second leg portions 52, 54. The conductive leg portions 50, 52, 54 of the parasitic element are substantially parallel with and correspond to conductive surfaces and the first and second leg elements 24, 26, 28 of the driven element 16. Parasitic element 18 is supported above ground plane 20 by the second leg portion 54 which is capacitively coupled to the ground plane 20 via foot 56 and dielectric member 58. As with the foot 42 and the dielectric element 48 of the driven element 16 forming a two plate capacitor 46, the foot 56 and the dielectric element 58 of the parasitic element 18 form a two plate capacitor 60. The parasitic element 18 is further supported by a first leg portion 52 which is electrically or operatively connected to the ground plane element 20 via foot 40. Note that the parasitic element 18 includes an interior region 68 similar to the interior region 30 of the driven element.

Figure 4:
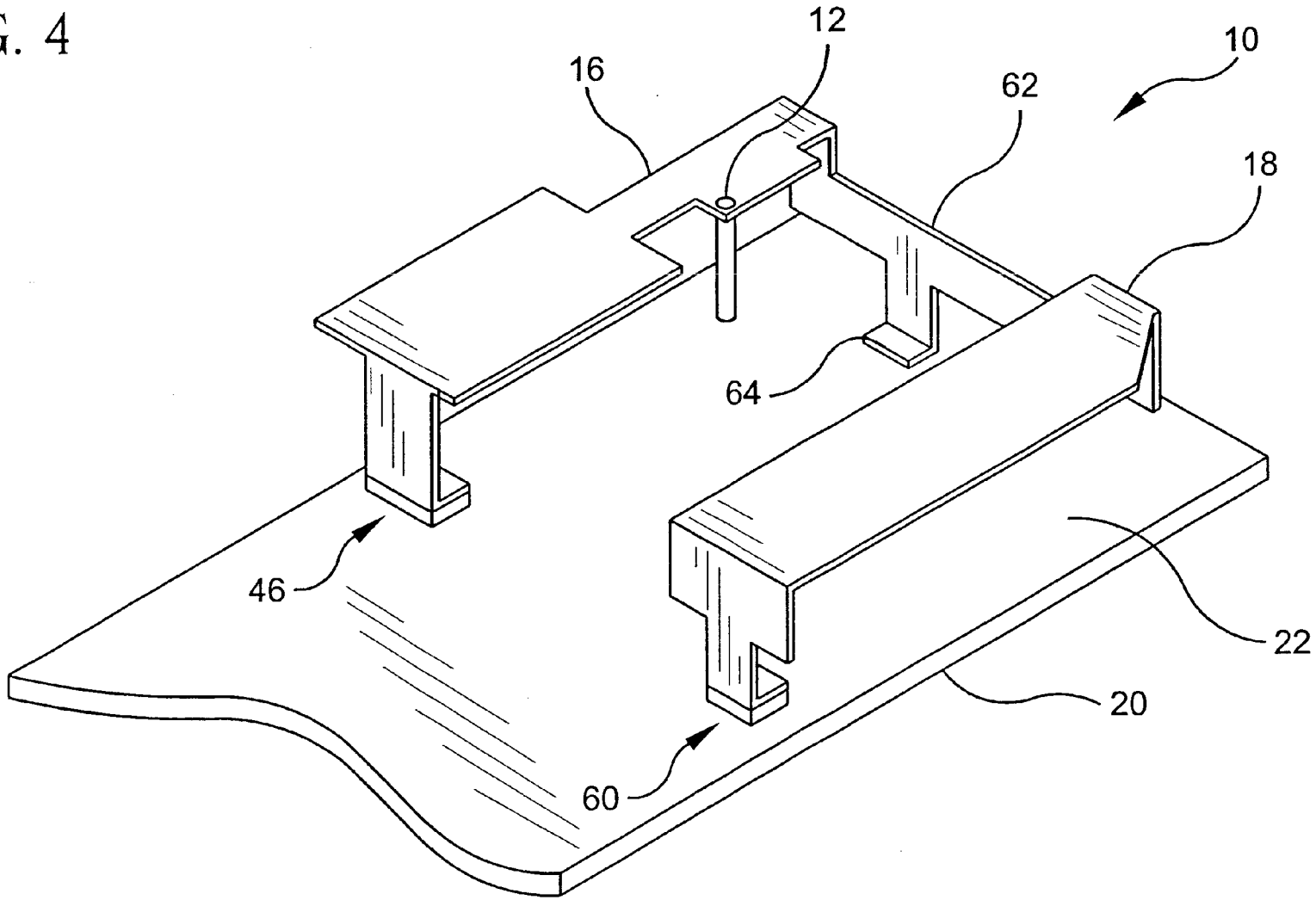
FIG. 4 is a perspective view of another embodiment of an antenna assembly according to the present invention.

FIG. 4 illustrates another embodiment of an antenna assembly 10 according to the present invention. The driven element 16 and the parasitic element 18 are coupled together via a coupling element 62. The coupling element 62 includes a foot 64 for operatively coupling both the driven element 16 and the parasitic element 18 to the ground plane 20 of the communication device. The driven element 16, parasitic element 18, and coupling element 62 may be formed from as a single metal part and be fabricated, for example, using high-speed metal stamping processes. In this manner, a compact antenna assembly is provided which is suitable for incorporation within efficient, high volume production of communication devices. The antenna element may thus be utilized in conjunction with surface mount device (SMD) production techniques.

Figure 5:
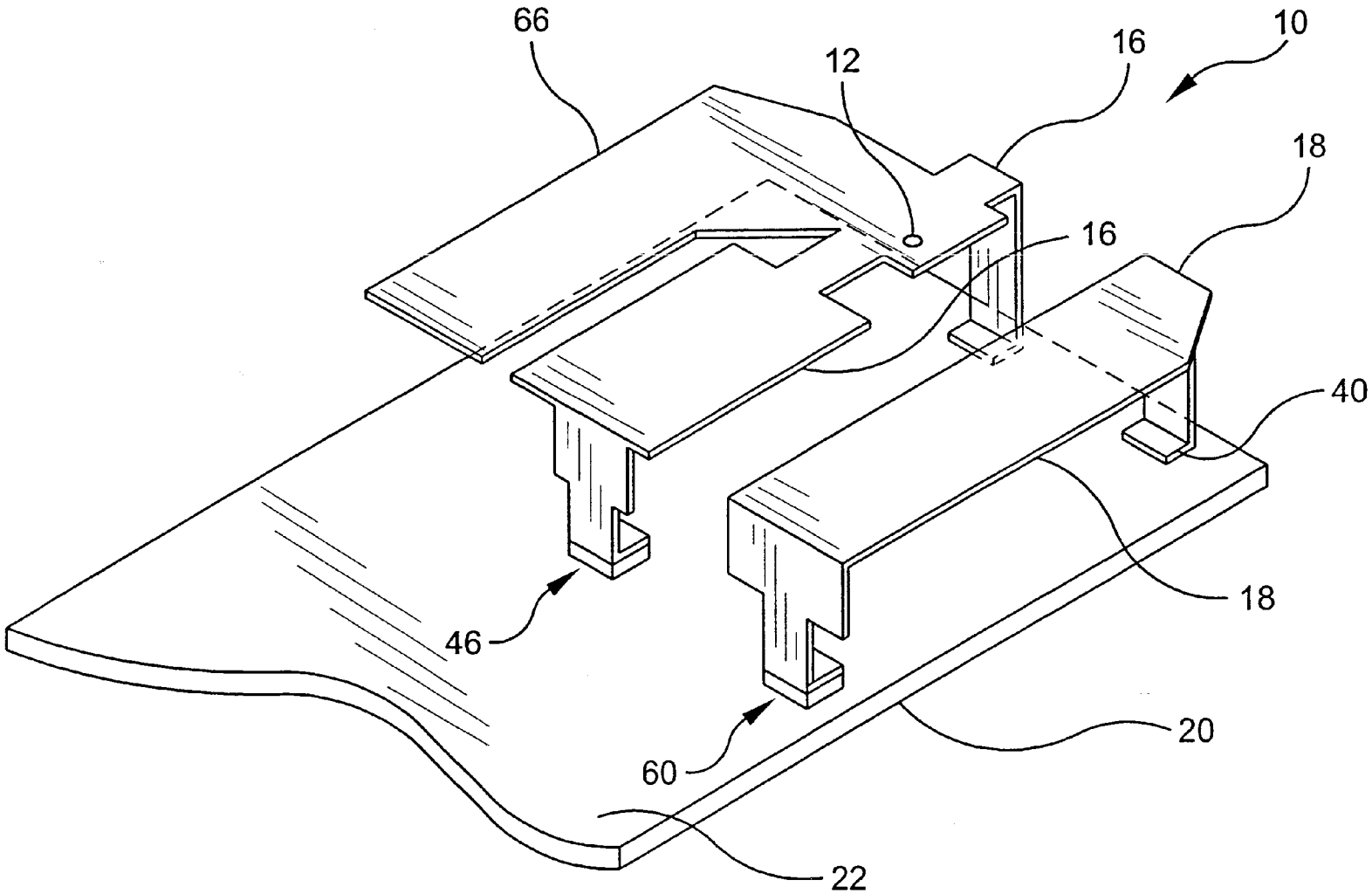
FIG. 5 is a perspective view of yet another embodiment of an antenna assembly according to the present invention including a dual band antenna circuit with parasitically coupled stagger tuned sections for the lower frequency band, and a single resonant section for the higher frequency band.

FIG. 5 illustrates another embodiment of an antenna assembly according to the present invention. The antenna of FIG. 5 optimally operates over a pair of frequency ranges, for example, such as cell band (824–894 MHz.) and PCS band (1850–1990 MHz.) ranges. Operation over a higher frequency range is attained by addition of an extension element 66 to the driven conductor element 16. Preferably, extension element 66 is disposed at a left side edge of the third portion 36 of the driven element 16. Dimensions of the extension element 66, which are sized to effectuate resonance at the higher frequency range, are provided in FIG. 8 and Table 1.

Figure 6:
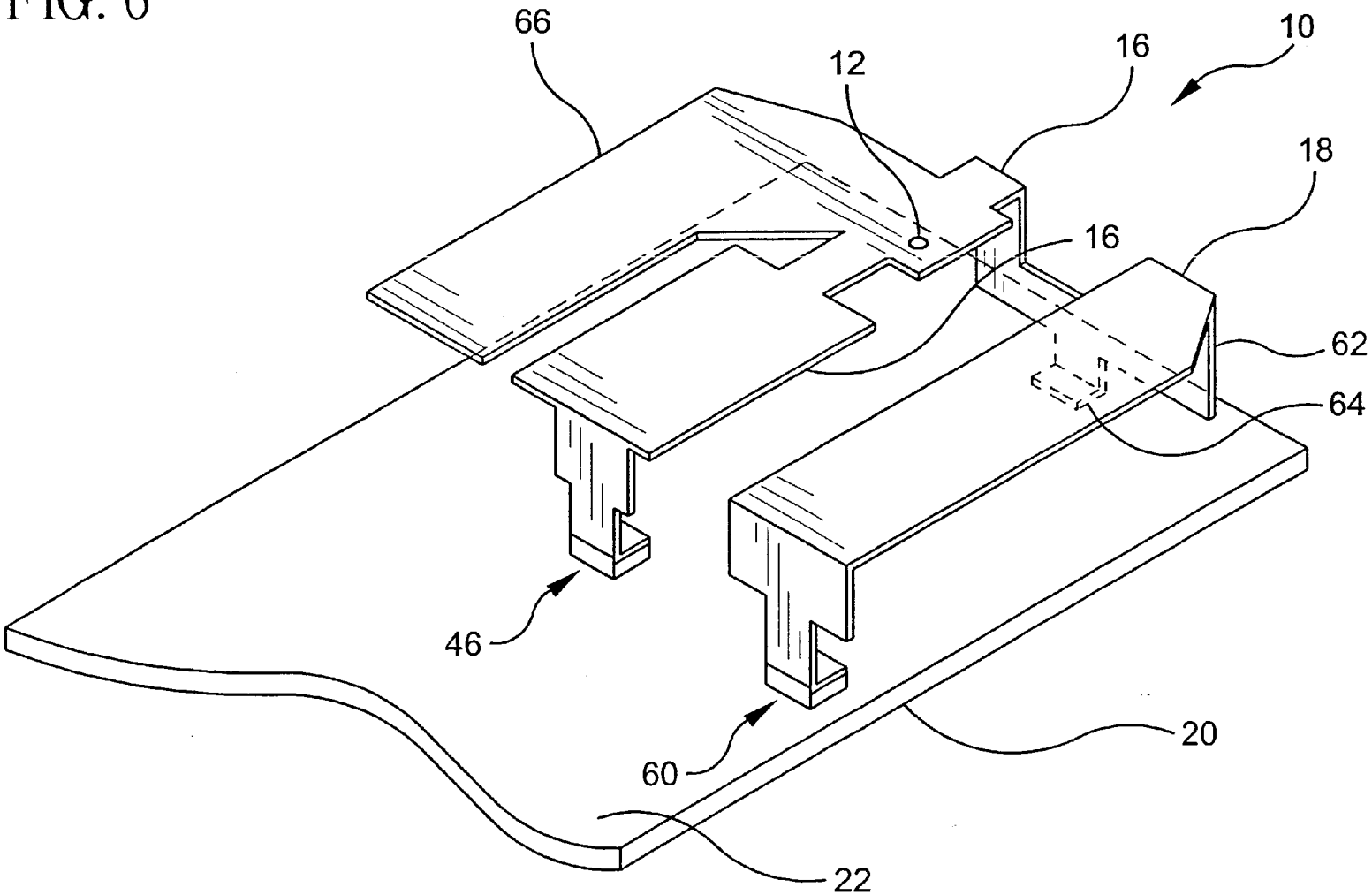
FIG. 6 is a perspective view of yet another embodiment of an antenna assembly according to the present invention providing sections joined to facilitate construction as a single stamped part.

FIG. 6 illustrates another embodiment of an antenna assembly according to the present invention. Similarly to FIG. 4, the driven element 16, parasitic element 18, and coupling element 62 are formed as a single unit and operatively connected to the ground plane member 20 at a single ground location via foot 64.

Figure 7:
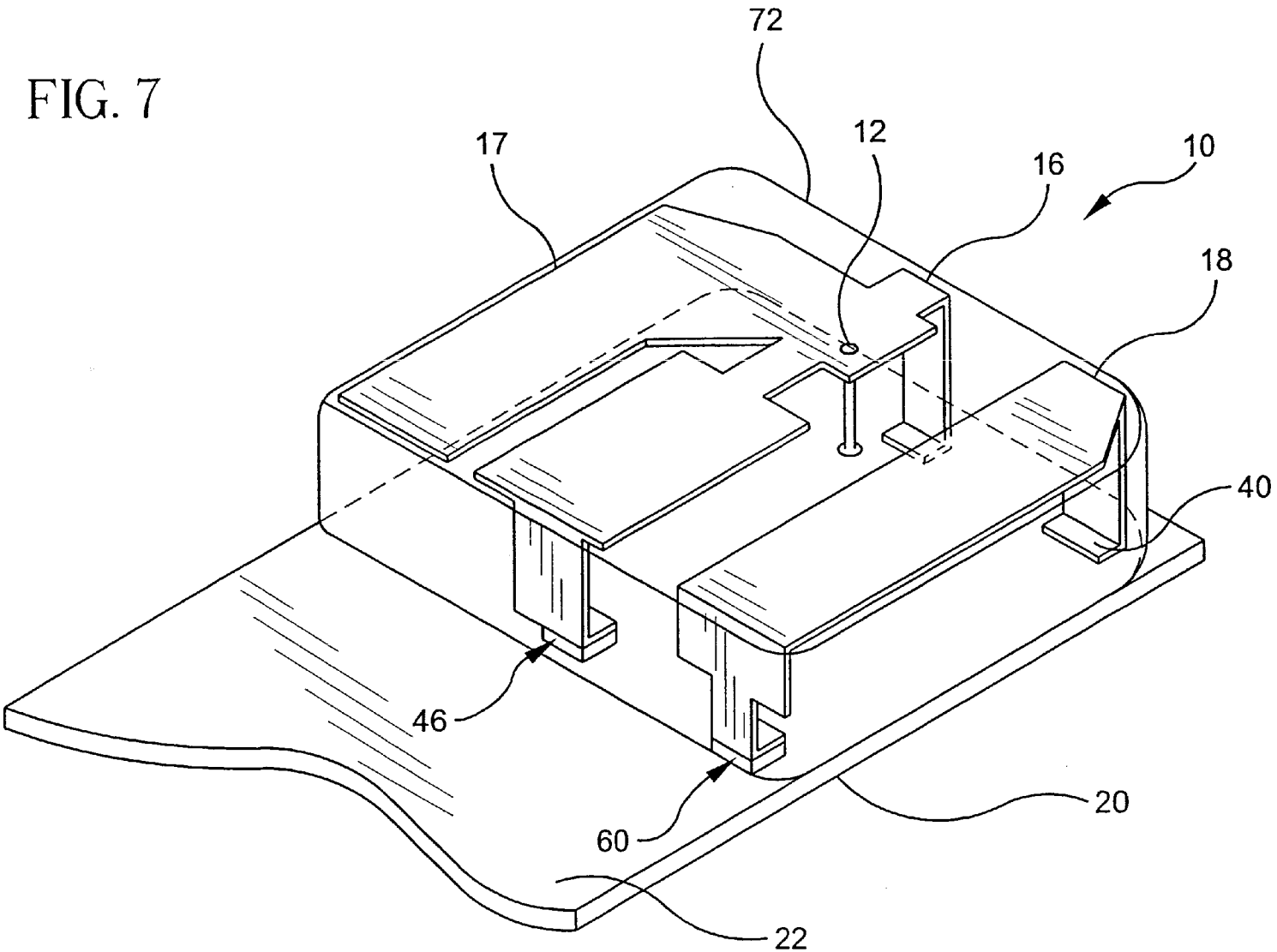
FIG. 7 is a perspective view of yet another embodiment of an antenna assembly according to the present invention.

FIG. 7 illustrates yet another embodiment of an antenna assembly according to the present invention. The driven element 16, parasitic element 18, and coupling element 62 are disposed upon a dielectric block or substrate 72. The driven element 16, parasitic element 18, and coupling element 62 may be a metal deposition upon the dielectric substrate 72 or formed using other known metal deposition or metal etching processes as those skilled in the relevant arts may appreciate.

Figure 9:
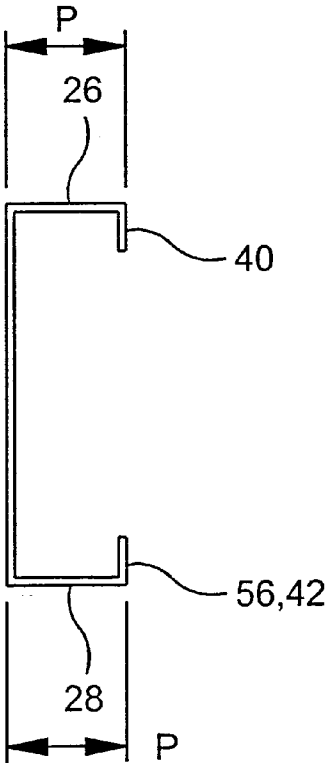
FIG. 9 is a side elevational view of the antenna assembly of FIG. 8.
Figure 8:
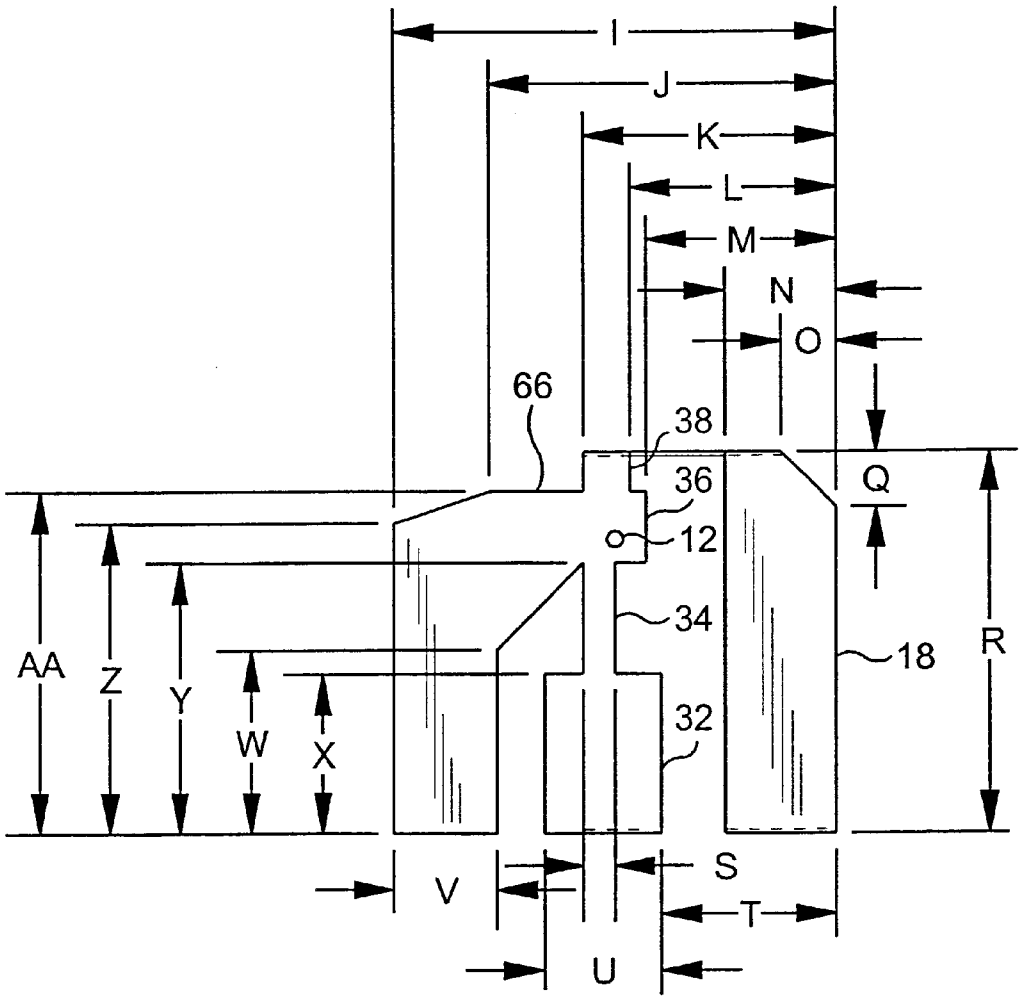
FIG. 8 is a top plan view of an antenna assembly according to the present invention as represented in FIGS. 1–7.

FIGS. 8 and 9, in conjunction with Table 1, disclose dimensions for preferred embodiments of an antenna assembly according to the present invention.

Figure 10:
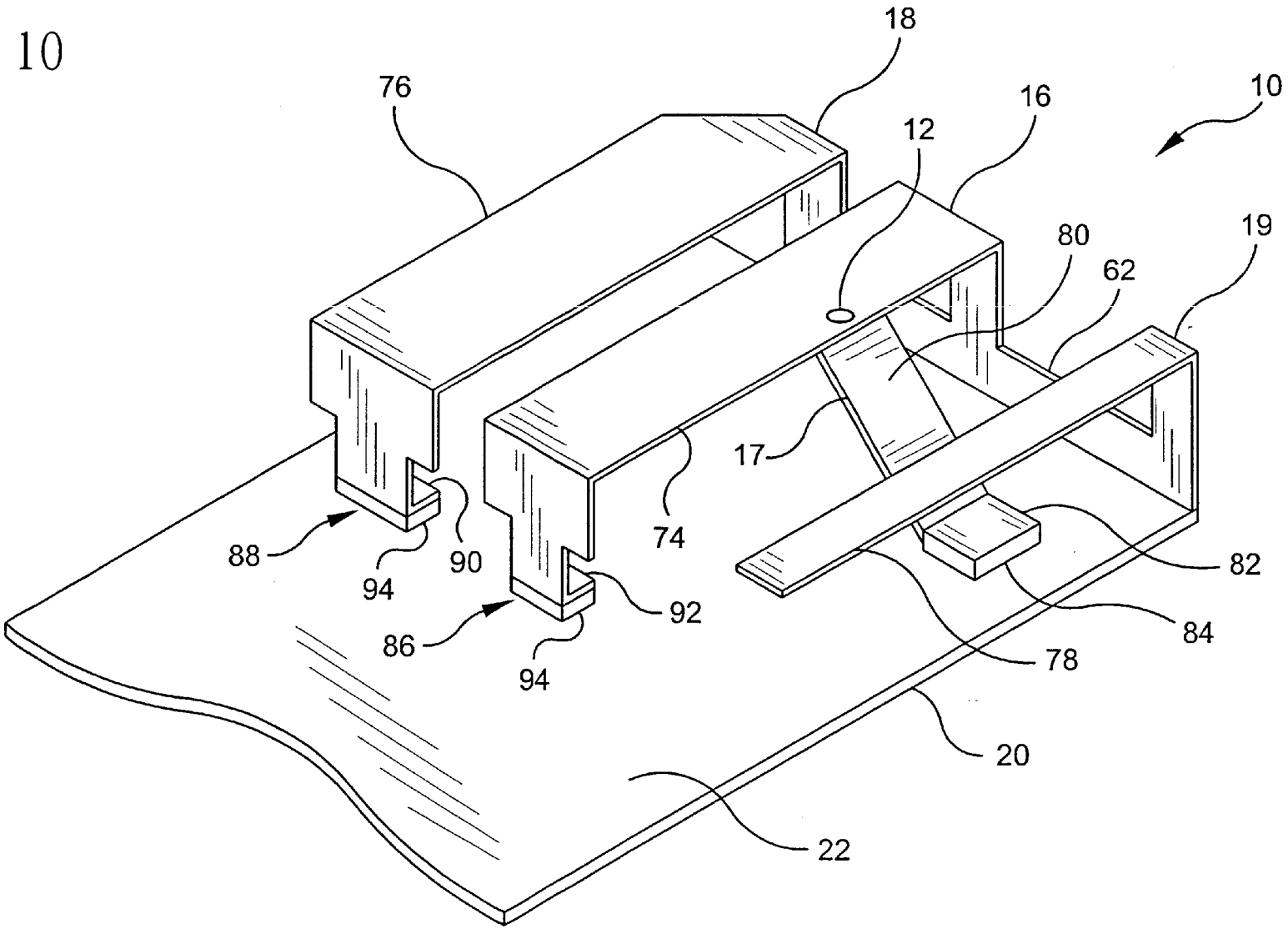
FIG. 10 is a perspective view of yet another embodiment of an antenna assembly according to the present invention.

FIG. 10 illustrates another embodiment of an antenna assembly according to the present invention, in particular a dual band antenna assembly suitable for operation over the cell band (824–894 MHz.) and PCS band (1850–1990 MHz.) frequency ranges. This antenna assembly includes low frequency and high frequency driven elements 16, 17 and low frequency and high frequency parasitic elements 18, 19, and for example, all elements being formed as a single stamped metal part. A coupling element 62 operatively connects the driven elements 16, 17 to the parasitic elements 18, 19 and is formed as a portion of the stamped metal part. Coupling element 62 is, in turn, operatively connected to the ground plane member 20 of the communication device 8 at an upper edge thereof. Low frequency driven element 16, low frequency parasitic element 18, and high frequency parasitic element 19 are each defined by a substantially rectangular planar top surface 74, 76, 78. The top surfaces 74, 76, 78 are substantially co-planar. The high frequency driven element 17 is defined by a substantially rectangular element 80 disposed at a side of the low frequency driven element 16 and downwardly angled toward a foot 82. Foot 82 is disposed upon a dielectric element 84 to capacitively couple the high frequency driven element 17 to the ground plane member 20 of the communication device. Dielectric member 84 may be a 1/32 inch thickness dielectric substrate having a dielectric constant between 1 and 10, and preferably about 3.0. Dielectric member 84 may be a dielectric substrate such as used for printed circuit boards, having a dielectric constant in the range of 1–10, or dielectric member 84 may be a chip capacitor.

Low frequency driven element 16 and low frequency parasitic element 18 are each operatively coupled at one end to the ground plane member 20 of the communication device via a capacitive coupling 86, 88 defined between a foot member 90, 92 and the ground plane 20. A dielectric element 94 may be disposed within each capacitive coupling 86, 88. In comparison, high frequency parasitic element 19 includes a free end.

The antenna assembly of FIG. 10 includes a feed point 12 at which a single conductor from the communication device may be coupled thereto. Operation at alternative frequency ranges may be practicable utilizing the concepts of this embodiment by scaling the relevant dimensions provided herein as those skilled in the arts will appreciate.

Figure 11:
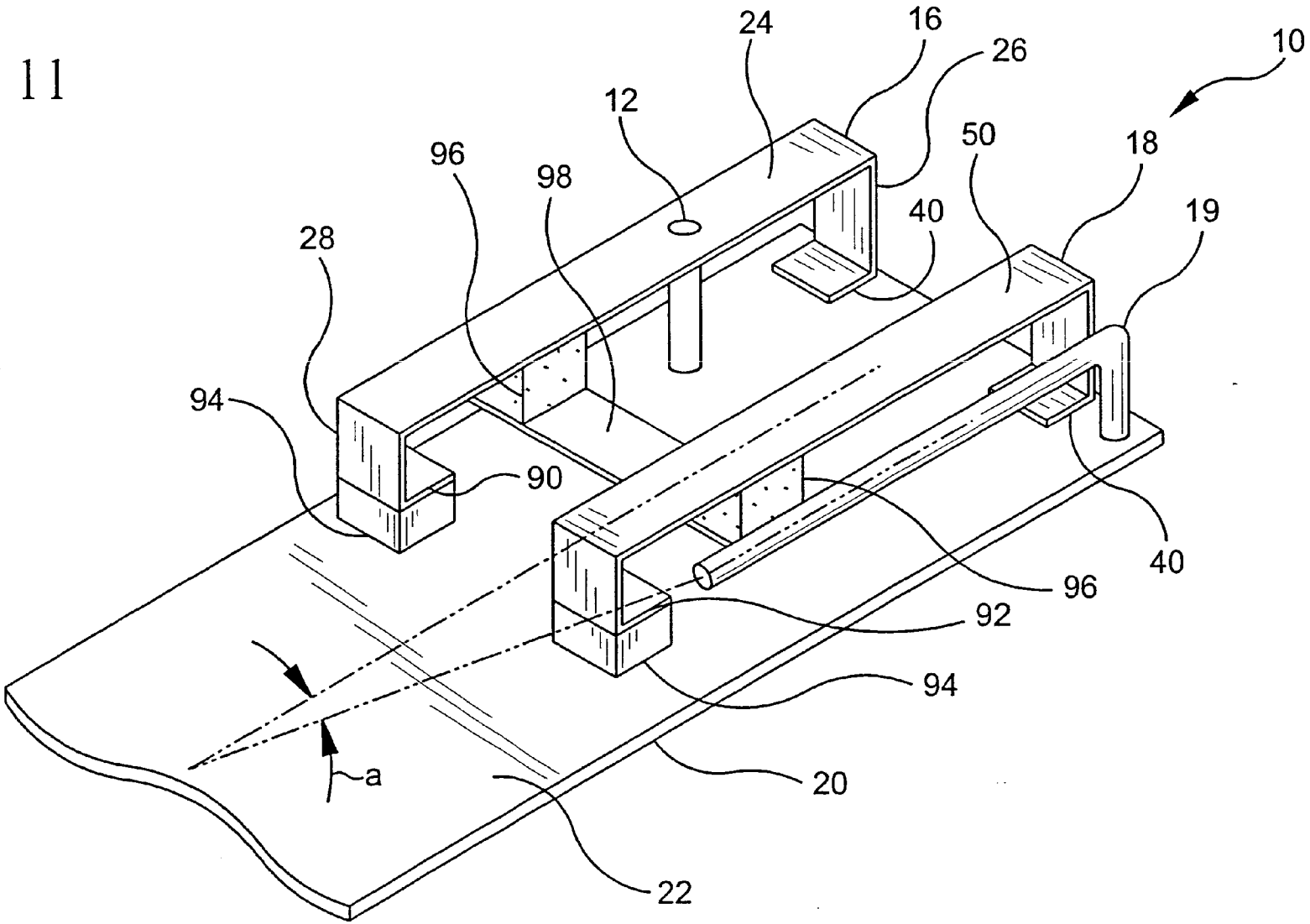
FIG. 11 is a perspective view of yet another embodiment of an antenna assembly according to the present invention.

FIG. 11 illustrates another embodiment a multiple band antenna assembly of the present invention. Driven element 16 is coupled at feed point 12 to the communication device via a single conductor. Driven element 16 is approximately 'C' shaped when view in profile and includes a top planar surface including the feed point 12, a first leg element 26 operatively connected near the upper edge of the ground plane element 20 of the printed wiring board via foot member 40, and a second leg element 28 capacitively coupled to the ground plane element 20 via foot 92 and capacitor element 94. A parasitic element 18 is disposed relative the driven element 16 and is similarly shaped. Parasitic element 18 is directly or operatively connected at one end near the upper edge of the ground plane element 20, and capacitively coupled at another end to the ground plane element 20. A perpendicular coupling section 98 is disposed between the driven element 16 and the low frequency parasitic element 18. Coupling section 98 is capacitively coupled to the driven element 16 and the low frequency parasitic element 18 via capacitor elements 96. The dielectric constant of the capacitor elements 96 may range from 1 (air) to approximately 10.

Antenna assembly of FIG. 11 further includes a high frequency parasitic element 19 directly or operatively connected at one end to the ground plane element 20 of the telecommunication device. High frequency parasitic element 19 may be a conductive wire element having a nominal 0.05 inch thickness and including an upper portion substantially aligned with the conductive surface and conductive portion 24, 50, respectively, of the driven element 16 and low frequency parasitic element 18. Note that high frequency parasitic element 19 is angled relative to the low frequency parasitic element 18 by an angle "$\alpha$" of between approximately 5–25 degrees.

Figure 12:
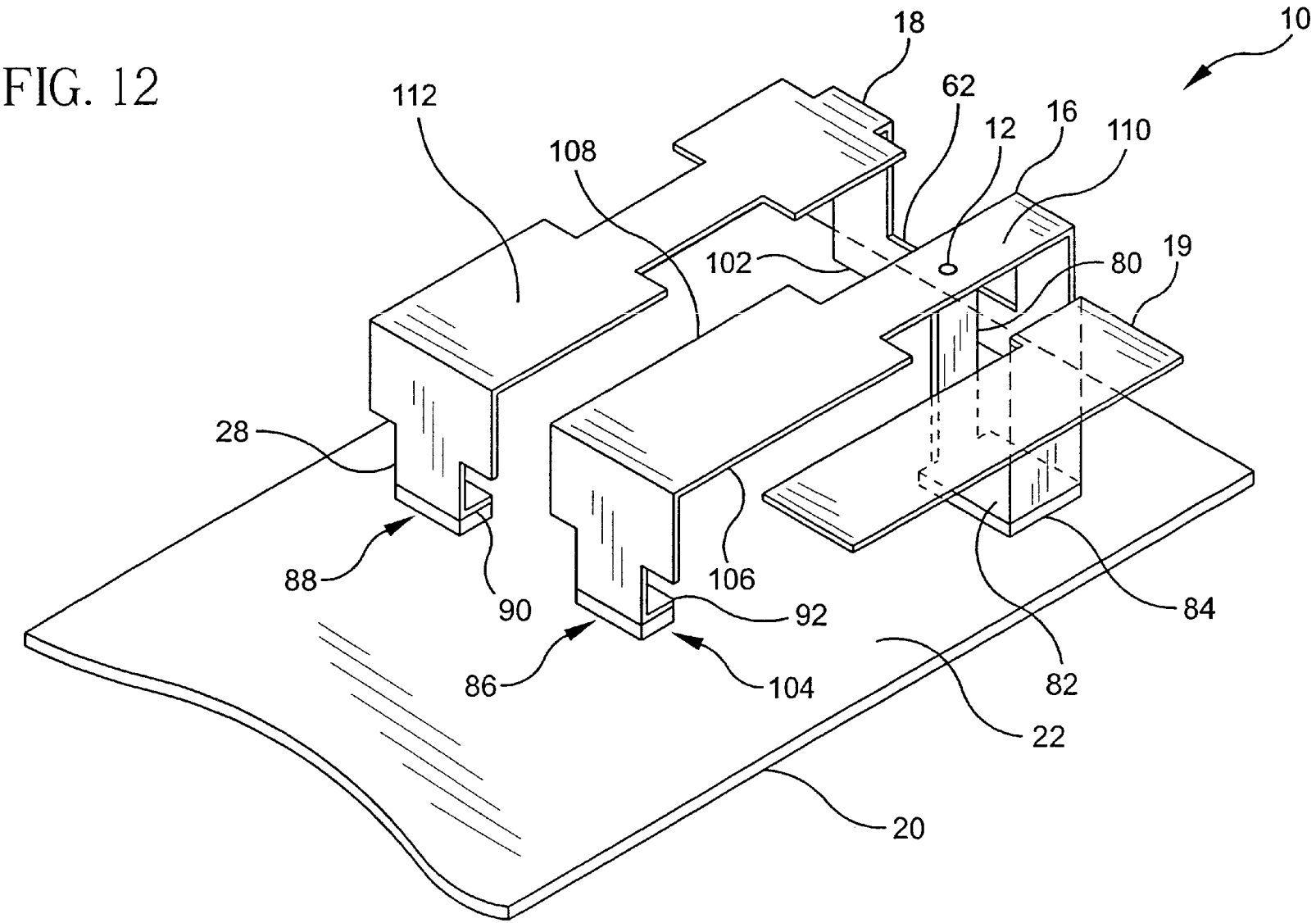
FIG. 12 is a perspective view of yet another embodiment of an antenna assembly according to the present invention.

FIG. 12 illustrates yet another embodiment of an antenna assembly 10 according to the present invention. The low frequency driven element 16 is directly or operatively connected at a first end to an upper portion 102 of the printed wiring board 22, and at a lower portion 104 of the printed wiring board 22 through capacitive coupler 86, and at feed point 12. Low frequency driven element 16 includes a top planar surface 106 including first and second portions 108, 110, the first portion 108 defined by a substantially rectangular area and the second portion 110 defined by a relatively smaller rectangular area. Feed point 12 is disposed within the second portion 110 of the top planar surface 106. High frequency driven element 80 is directly coupled at an edge of the low frequency driven element 16 (at the second portion 110) and is capacitively coupled at the other end to the ground plane 20 of the printed wiring board via foot element 82 and dielectric element 84. High frequency parasitic element 19, which is defined by a substantially rectangular area, is also capacitively coupled to the ground plane member 20 through common foot element 82 and dielectric element 84.

Still referring to FIG. 12, the low frequency parasitic element 18, which is disposed on the opposite side of the low frequency driven element 16, is capacitively coupled at a first end to the ground plane element 20 of the printed wiring board and at the opposite end to a coupling element 62 directly connected to the ground plane element 20. Low frequency parasitic element 18 includes a top planar surface 112 having a plurality of portions defined by varying width dimension. Coupling element 62 electrically connects the low frequency parasitic element 18 to the low frequency driven element 16.

Figure 13:
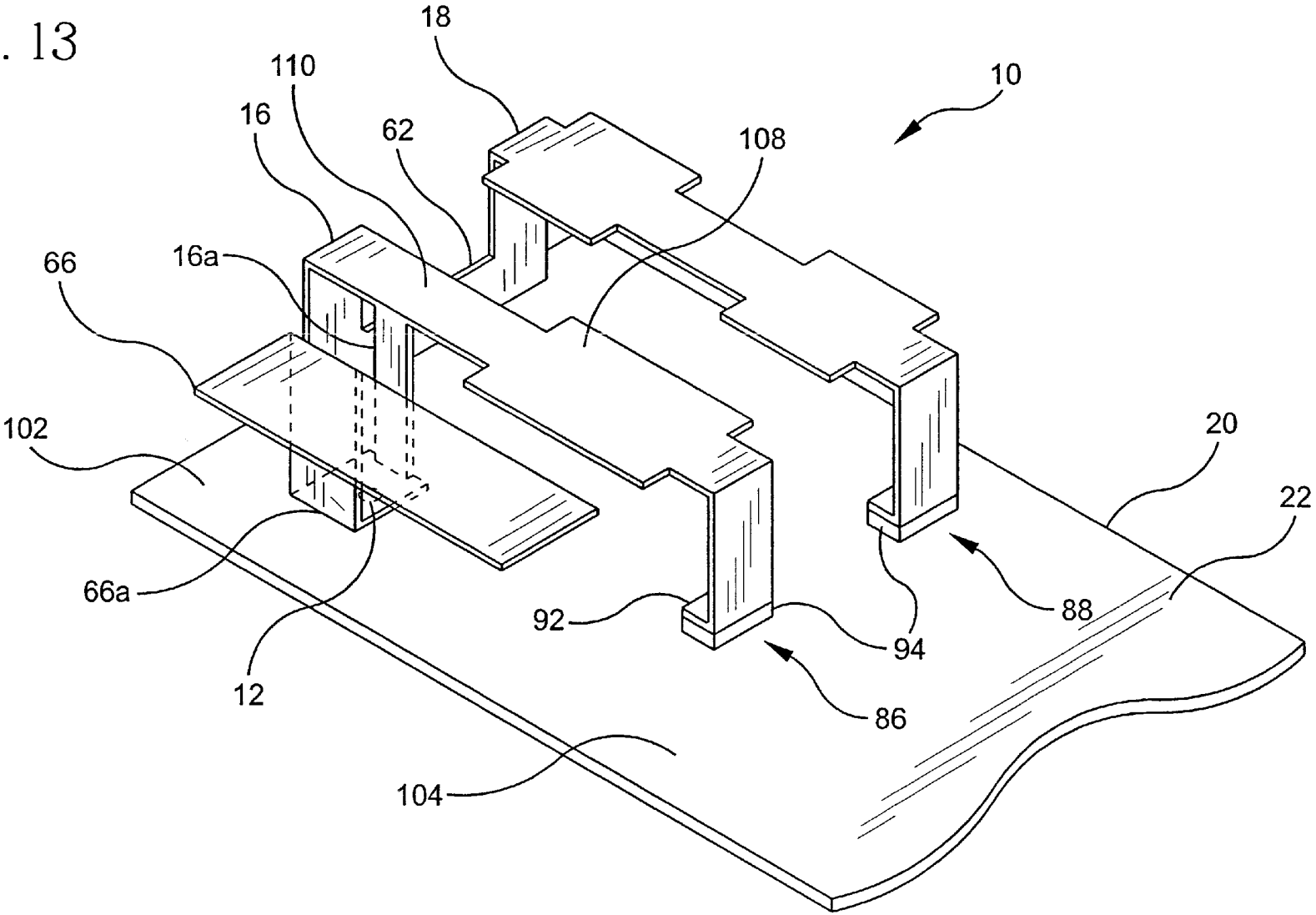
FIG. 13 is a perspective view of yet another embodiment of an antenna assembly according to the present invention.

FIG. 13 illustrates yet another embodiment of an antenna assembly 10 according to the present invention. The driven element 16 is directly or operatively connected at a first end to an upper portion 102 of the printed wiring board 22, and at a lower portion 104 of the printed wiring board 22 through capacitive coupler 86. The driven element 16 includes a top planar surface including first and second portions 108, 110, the first portion 108 defined by a substantially rectangular area and the second portion 110 defined by a relatively smaller rectangular area. Driven element 16 further includes a downwardly directed conductive surface 16*a* which is coupled at a lower foot surface to a feed point 12. Operation over a higher frequency range is attained by addition of an extension element 66 to the driven conductor element 16. Preferably, extension element 66 is disposed at a side edge away from the parasitic element 18. Extension element 66 includes a downwardly directed conductive surface 66*a* which is coupled at a lower foot surface to the feed point 12. The feed point 12 is preferably disposed a predetermined distance above the surface of the printed wiring board 22. The foot surface defining the feedpoint 12 is illustrated as a planar surface, though alternatively, the pair of downwardly directed surfaces 16*a*, 66*a* could be joined without the planar foot surface.

Still referring to FIG. 13, the parasitic element 18, which is disposed on the side of the driven element 16 opposite the extension element 66, is capacitively coupled at a first end to the ground plane element 20 of the printed wiring board 22 and at the opposite end to a coupling element 62 directly connected to the ground plane element 20. Parasitic element 18 includes a top planar surface having a plurality of portions defined by varying width dimension. Coupling element 62 electrically connects the parasitic element 18 to the low frequency driven element 16.

Figure 14:
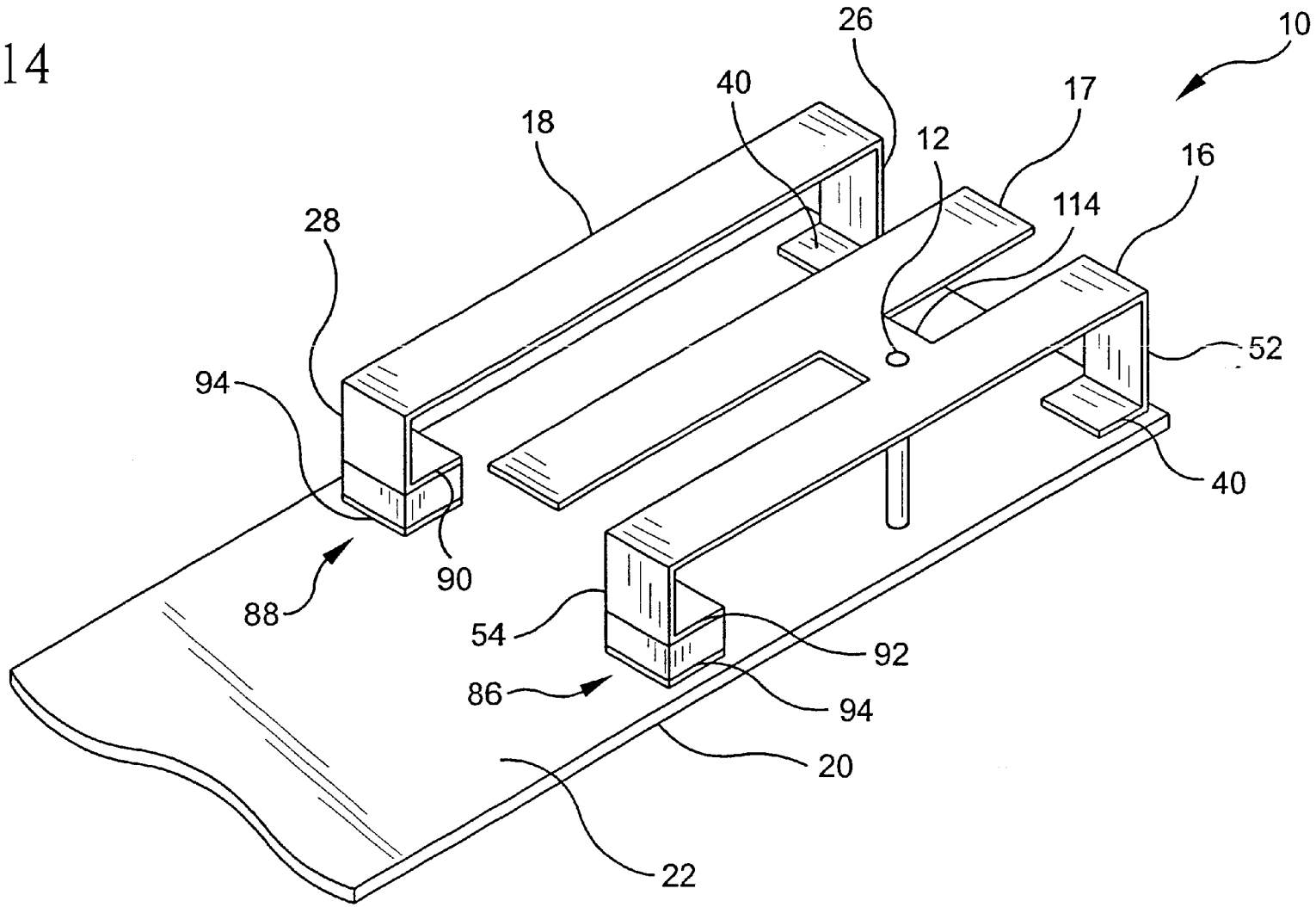
FIG. 14 is a perspective view of yet another embodiment of an antenna assembly according to the present invention.

Referring now to FIG. 14, another embodiment of an antenna assembly according to the present invention is provided. A dual band antenna includes a driven element 16 for the lower frequency band and a high frequency driven element 17 disposed away therefrom. The high frequency and low frequency driven elements 16, 17 are each defined by substantially planar rectangular portions which are coupled via a conductive spacer portion 114. A feed point 12 is provided between the driven elements 16, 17 and a signal conductor from the printed wiring board 22. A low frequency parasitic element 18 is disposed further away from the low frequency driven element 16 as indicated.

Figure 15:
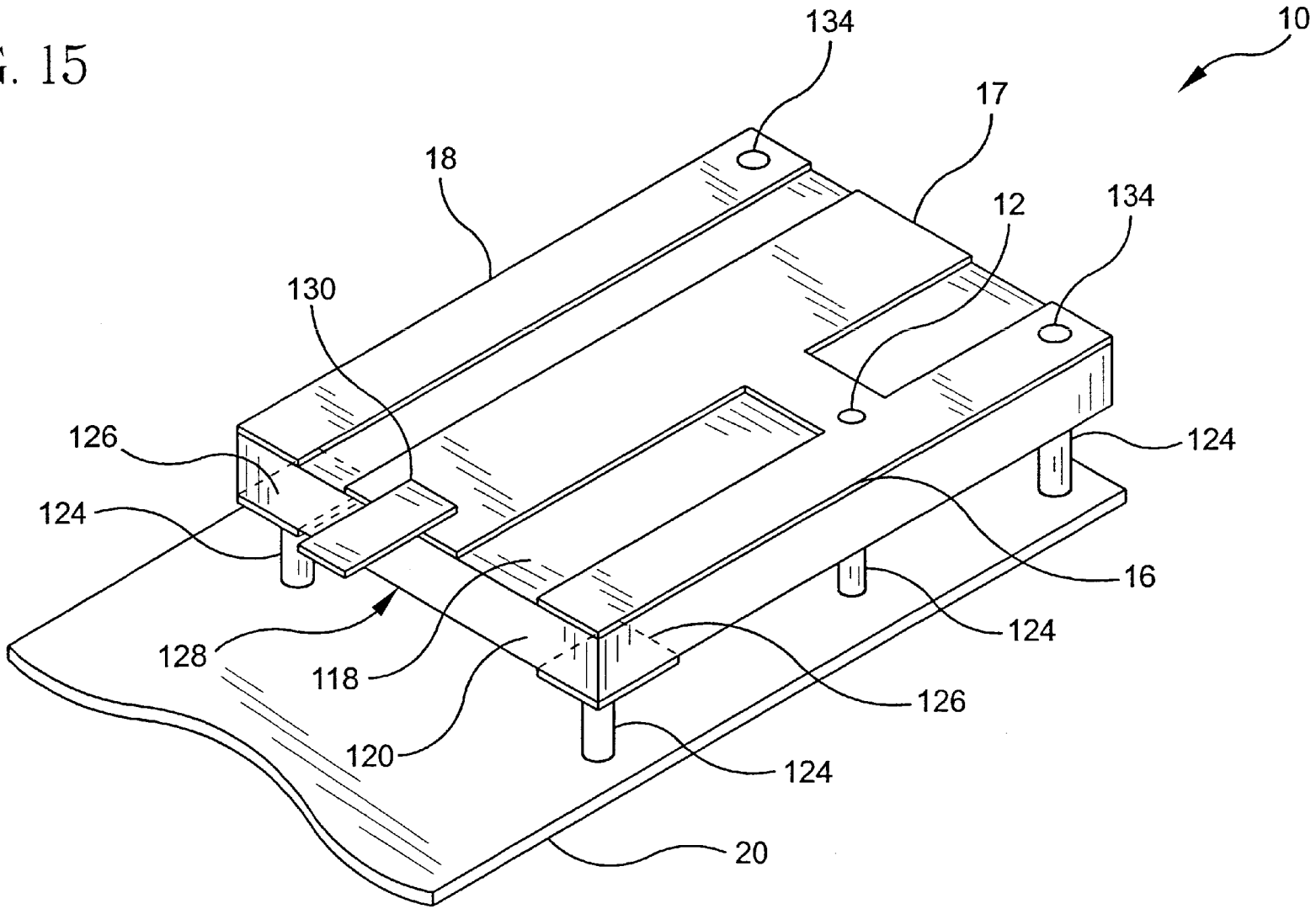
FIG. 15 is a perspective view of yet another embodiment of an antenna assembly according to the present invention.

FIG. 15 illustrates another preferred embodiment of an antenna assembly according to the present invention wherein the driven elements 16, 17 and the parasitic element 18 are disposed upon an upper major surface 118 of a dielectric block element 120. The driven elements 16, 17 and parasitic element 18 may be made as metal depositions upon the dielectric block or otherwise patterned from a plated dielectric stock material. Dielectric block element 120 has a dielectric constant of between 1 and 10, and more preferably approximately 3.0. The dielectric block 120 is supported a distance away from the printed wiring board 22 of the communication device by conductive spacer elements 124.

The spacer elements 124 additionally operatively or directly connect the driven elements 16, 17 and parasitic elements 19 to the ground plane member 22 at attachment points 134. Low frequency driven element 16 and the parasitic element 18 are each capacitively coupled at respective ends to the ground plane 20. Note that bottom plate elements 126 are disposed upon the opposite major surface 128 of the dielectric substrate 120 and are electrically coupled to the ground plane member 20 via truncated conductive spacer elements 124. A tuner element 130 is disposed at one end of high frequency driven element 17 and may be adjusted relative to the ground plane element 20 to adjust the resonant frequency of the higher frequency antenna.

FIG. 16 illustrates another aspect of the present invention which provides for an extended ground plane element 140 for use in conjunction with the antenna assemblies disclosed herein. The overall length of the ground plane member 20, 140 (the electrical length) is preferably greater than one-quarter wavelength for a preselected wavelength in the operational frequency band. Applicants have determined that the electrical length of the ground plane 20, 140 in large part determines the gain of the antenna assembly. One limitation of smaller hand held communication devices is that the ground plane 20, 140 has an electrical length which is less than optimal. For communication devices having a lower flip panel portion 142, the ground plane length 20, 140 may be extended by coupling a conductive panel 144 of the flip panel portion 142 to the main ground plane 20 of the printed wiring board 22. The conductive panel 144 may be a separate conductor element or a conductive layer disposed upon an existing surface of the flip panel portion 142. The coupling device 146 may be selected from among a group of known electrical coupling techniques as appreciated by those skilled in the relevant arts.

Particular dimensions for preferred embodiments according to the present invention are included as Table 1.

TABLE 1

| Dimension | Inch |
|---|---|
| i. | 1.600 |
| j. | 1.260 |
| k. | .925 |
| l. | .775 |
| m. | .725 |
| n. | .400 |
| o. | .200 |
| p. | .395 |
| q. | .200 |
| r. | 1.330 |
| s. | .100 |
| t. | .640 |
| u. | .420 |
| v. | .360 |
| w. | .610 |
| x. | .530 |
| y. | .950 |
| z. | 1.080 |
| AA. | 1.200 |

Figure 17:
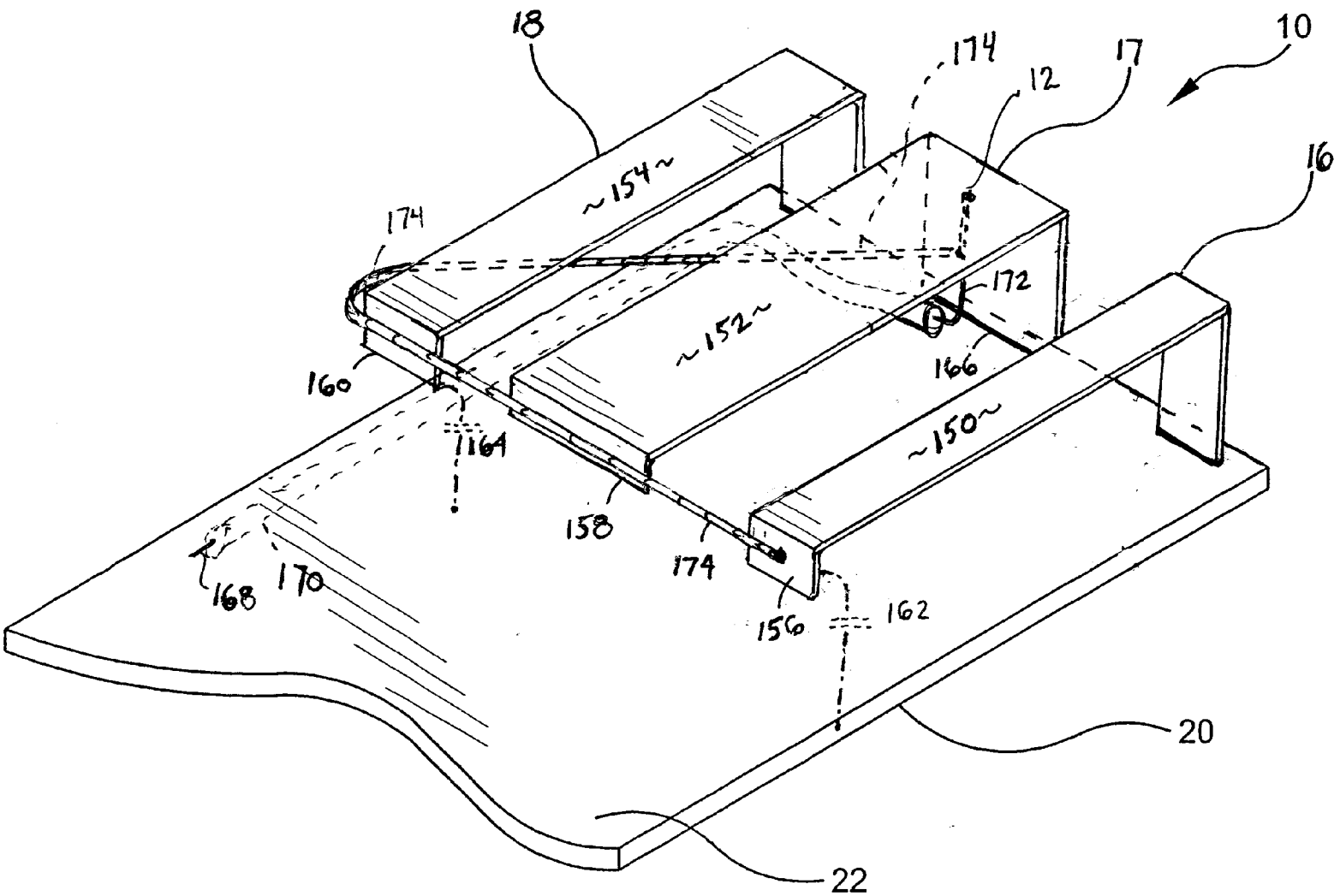
FIG. 17 is a perspective view of another embodiment of an antenna assembly according to the present invention.
Figure 18:
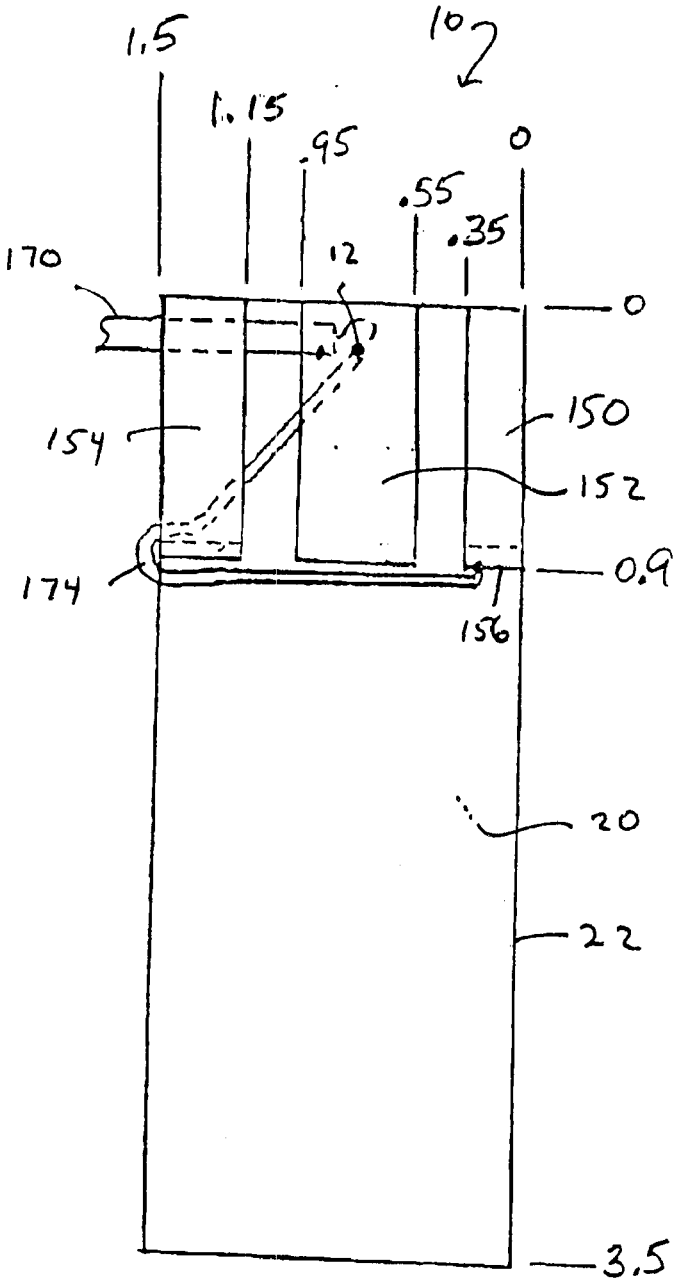
FIG. 18 is a top plan view of the antenna assembly of FIG. 17.
Figure 19:
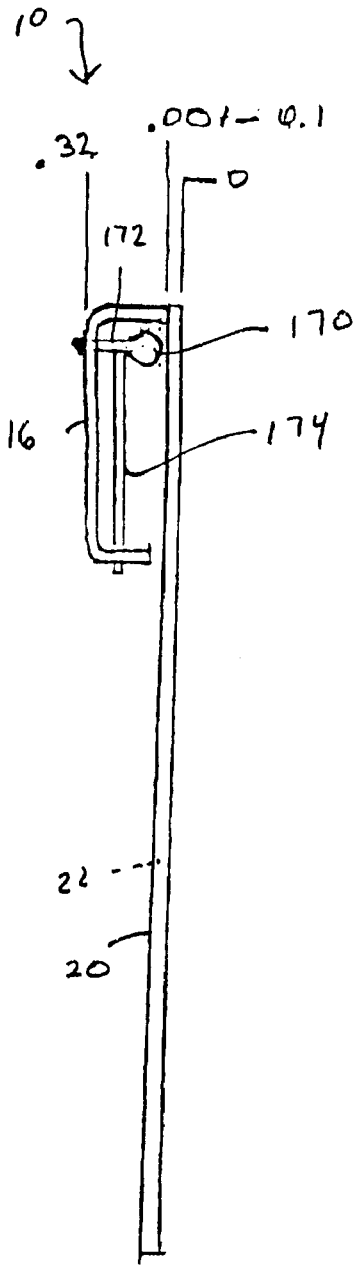
FIG. 19 is a side elevational view of the antenna assembly of FIG. 17.

FIGS. 17–19 illustrate another embodiment of an antenna assembly according to the present invention, in particular a dual band antenna assembly suitable for operation over the US cell band (824–894 MHz) and PCS band (1850–1990 MHz) frequency ranges. Operation at alternative frequency ranges may be practicable utilizing the concepts of this embodiment by scaling the relevant dimensions provided herein as those skilled in the arts will appreciate. An antenna assembly 10 disclosed in FIGS. 17–19 consists of a voltage-fed, stagger tuned resonator 16 and parasitic resonator element 18 operating at a lower frequency band. The resonators 16, 18 are stagger tuned to promote bandwidth, and are operated in conjunction with a ground plane 20 having a minimum length of ¼λ. A second shunt fed resonator 17 for one for more higher frequency bands is disposed in operational relationship to the first resonators 16, 18. As a result, this antenna assembly includes low frequency and high frequency resonator elements 16, 17 and a low frequency parasitic element 18. In one preferred embodiment, elements 16, 17, 18 may be formed as stamped metal parts. Alternative approaches to manufacturing elements 16, 17, 18 would also be appreciated by those skilled in the relevant arts, e.g., plated plastic, wire form, and printed circuit board fabrication.

Elements 16, 17, 18 are each defined by a substantially rectangular planar top surface 150, 152, 154. The top surfaces 150, 152, 154 are substantially co-planar and disposed a predetermined distance away from the ground plane 20. Elements 16, 17, 18 are generally C-shaped and are coupled to the ground plane 20 at one end. Elements 16, 17, 18 each include a free end 156, 158, 160, respectively, disposed away from the ground connections. Elements 16 and 18 may optionally be capacitively coupled to ground plane 20 at respective free ends 156, 160 by capacitive tuning elements 162, 164. Optional capacitive tuning elements 162, 164 may be a chip capacitor, an air dielectric parallel plate capacitor, or other suitable capacitive tuning devices or networks. The ground plane 20 forms a portion of the antenna 10 and has a minimum electrical length of ¼ at the lowest frequency of operation. The ground plane 20 may include ground traces of the printed wiring board of a wireless communications device. Ground plane 20 of FIGS. 17–19 is illustrated as generally rectangular in shape. Alternative ground plane 20 configurations or shapes may also be utilized to practice an embodiment of the present invention. The coupling to ground plane 20 may be made via soldering, or other known electrical coupling techniques.

The dimensions of high frequency resonator element 17 and the distributed capacitance between element 17 and the ground plane 20 determine the resonant frequency of element 17. Low frequency resonator element 16 and low frequency parasitic element 18 are tuned to the lower frequency band of operation, such as the US cell band, 824–894 MHz, in one preferred embodiment.

A feed point 12 is defined upon the top surface 152 of the high frequency element 17. High frequency resonator element 17 is shunt fed, with a ground connection at location 166 and a connection to the center conductor 168 of the coax signal line 170 at feed point 12. As illustrated in FIG. 17, a conductor 172 is connected to the center conductor 168 of coax signal line 170. Conductor 172 may be an extension of the center conductor 168 of the coax signal line 170. Conductor 172 is also connected to one end of a high impedance line 174 which extends away from feed point 12 and around the free ends 158, 160 of elements 17 and 18. The high impedance line 174 is connected at its other end to the free end 156 of element 16. The high impedance line 174 is optimally ¼λ in electrical length (λ: approximately at the mid frequency of the band), and serves to transform the 50 ohm input/output impedance to the higher impedance at the free end 156 of element 16. This feed approach, in conjunction with stagger tuning of resonator elements 16, 18, results in greater bandwidth, gain, and front-to-back ratio as compared to shunt feeding near the low impedance end of element 16. The high impedance line 174 may be a single wire above the ground plane 20 as illustrated in FIG. 17, or alternative may be a microstrip transmission line (not shown).

In operation, an antenna of FIGS. 17–19 exhibits a front to back ratio of 4.5 dB in the lower frequency range, and 6–10 dB in the high frequency range. The polarization in both bands is linear, along the major dimension of ground plane 20. A maximum gain is generally in the direction away extending away from the ground plane 20 surface upon which the antenna 10 is disposed.

FIG. 18 is a top plan view of the antenna assembly of FIG. 17, illustrated in reference to a printed wiring board 22 defining a ground plane 20 and illustrating dimensions of an antenna assembly operational over then particular a dual band antenna assembly suitable for operation over the US cell band (824–894 MHz) and PCS band (1850–1990 MHz) frequency ranges.

FIG. 19 is a side elevational view of the antenna assembly of FIG. 17, illustrating dimensions of an antenna assembly operational over then particular a dual band antenna assembly suitable for operation over the US cell band (824–894 MHz) and PCS band (1850–1990 MHz) frequency ranges.

In operation and use the antenna assemblies according to the present invention are extremely efficient and effective. The antenna assemblies provide improved directivity, broadband input impedance, increased signal strength, and increased battery life. The antenna of the present invention reduces radio frequency radiation incident to the user's body, and reduces the physical size requirements of directional antenna used in cell phone handsets, PCS devices and the like. The disclosed antenna also increases front-to-back ratios, reduces multipath interference, and is easily integrated into the rear panel portion of a cellular transceiver device to minimizes the risk of damage or interference. Additionally, beamwidth and bandwidth enhancement in the direction away from the user is achieved particularly when the antenna assembly is used in conjunction with hand-held wireless communication devices. Beamwidths of 1.5–2 times greater than for a dipole antenna have been recognized.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An antenna assembly for use in a wireless communications device, the antenna assembly comprising:

a conductive ground plane element;

a high frequency resonator element having a conductive surface disposed a predetermined distance away from the ground plane element and having a ground end and a free end, said ground end being coupled to the ground plane element, said resonator element having a shunt feed point disposed on the conductive surface proximate the ground end;

a low frequency resonator element having a conductive surface disposed a predetermined distance away from the ground plane element and having a ground end and a free end, said ground end being coupled to the ground plane element; and a conductive element functioning as high impedance transmission line, said conductive element coupling the low frequency resonator element to the high frequency resonator element, said conductive element having a first end and a second end, said first end being connected proximate to the shunt feed point and said second end being connected at the free end of the low frequency resonator element.

2. An antenna according to claim 1, wherein the ground plane element is defined by a portion of the ground traces of a printed wiring board.

3. An antenna according to claim 1, wherein the ground plane element has a dimension of at least one-quarter of an operational wavelength.

4. An antenna according to claim 1, wherein the high frequency resonator element includes a plurality of generally planar surfaces, including a top planar surface which is generally parallel to the ground plane element.

5. An antenna according to claim 1, wherein the high frequency resonator element and the low frequency resonator element are coupled to the ground plane element proximate an edge of the ground plane element.

6. An antenna according to claim 1, wherein the conductive element functioning as a high impedance transmission line is selected from among the group including: a single conductive wire, a microstrip transmission line, and a bent metal conductor.

7. An antenna according to claim 1, wherein the conductive element functioning as a high impedance transmission line has an electrical length of approximately one-quarter wavelength of a wavelength proximate a middle frequency of an operational frequency band.

8. An antenna according to claim 1, wherein the conductive element functioning as a high impedance transmission line is coupled to the low frequency resonator element proximate its free end and is coupled to the high frequency resonator element proximate its ground end.

9. An antenna according to claim 1, further comprising:

a parasitic low frequency resonator element having a conductive surface disposed a predetermined distance away from the ground plane element and having a ground end and a free end, said ground end being coupled to the ground plane element.

10. An antenna according to claim 1, further comprising:

a capacitive tuning element coupled between the free end of the low frequency resonator element and the ground plane element.

11. An antenna according to claim 10, further comprising:

a capacitive tuning element coupled between the free end of the parasitic low frequency resonator element and the ground plane element.

12. An antenna according to claim 1, wherein the low frequency resonator element and the high frequency resonator element are bent metal components.

13. An antenna assembly for use in a wireless communication device, the antenna assembly comprising:

a conductive ground plane element;

a high frequency resonator element having a conductive surface disposed a predetermined distance away from the ground plane element and having a ground end and a free end, said ground end being coupled to the ground plane element, a shunt feed location on the conductive surface of the high frequency resonator element substantially closer to the ground end than the free end;

a low frequency resonator element having a conductive surface disposed a predetermined distance away from the ground plane element and having a ground end and a free end, said ground end being coupled to the ground plane element; and a conductive element functioning as high impedance transmission line, said conductive element being coupled between the shunt feed location of the high frequency resonator element and the free end of the low frequency resonator element.

14. An antenna according to claim 13, wherein the ground plane element is defined by a portion of the ground traces of a printed wiring board.

15. An antenna according to claim 13, wherein the ground plane element has a dimension of at least one-quarter of an operational wavelength.

16. An antenna according to claim 13, wherein the high frequency resonator element includes a plurality of generally planar surfaces, including a top planar surface which is generally parallel to the ground plane element.

17. An antenna according to claim 13, wherein the high frequency resonator element and the low frequency resonator element are coupled to the ground plane element proximate an edge of the ground plane element.

18. An antenna according to claim 13, wherein the conductive element functioning as a high impedance transmission line is selected from among the group including: a single conductive wire, a microstrip transmission line, and a bent metal conductor.

19. An antenna according to claim 13, wherein the conductive element functioning as a high impedance transmission line has an electrical length of approximately one-quarter wavelength of a wavelength proximate a middle frequency of an operational frequency band.

20. An antenna according to claim 13, further comprising:

a parasitic low frequency resonator element having a conductive surface disposed a predetermined distance away from the ground plane element and having a ground end and a free end, said ground end being coupled to the ground plane element.

21. An antenna according to claim 13, further comprising:

a capacitive tuning element coupled between the free end of the low frequency resonator element and the ground plane element.

22. An antenna according to claim 21, further comprising:

a capacitive tuning element coupled between the free end of the parasitic low frequency resonator element and the ground plane element.

23. An antenna according to claim 13, wherein the low frequency resonator element and the high frequency resonator element are bent metal components.

24. A method of manufacturing an antenna assembly for use in a wireless communications device having a ground plane and a signal conductor, the method including the steps of:

forming a high frequency resonator element of a substantially planar conductive material, said element having a conductive surface and a ground leg and a free end;

coupling the ground leg of the high frequency resonator element to the ground plane, said conductive surface of the high frequency resonator element being disposed substantially parallel to the ground plane;

forming a low frequency resonator element out of a substantially planar conductive material, said element having a conductive surface and a ground leg and a free end;

coupling the ground leg of the low frequency resonator element to the ground plane, said conductive surface of the low frequency resonator element being disposed substantially parallel to the ground plane;

coupling the signal conductor of the wireless communications device at a feed point defined upon the conductive surface of the high frequency resonator element; and coupling a high impedance conductive signal transmission line between the signal conductor and the free end of the low frequency resonator element.

25. The method of claim 24, wherein the step of forming the high frequency resonator element comprises the steps of:

stamping a pattern from a sheet of conductive material, and bending ends of the pattern to form the conductive surface and the ground leg.

* * * * *